United States Patent [19]

Moll et al.

[11] 4,414,450

[45] Nov. 8, 1983

[54] HIGH VOLTAGE POWER SWITCH

[75] Inventors: Rudolf Moll, Zollikon; Klaus Ragaller, Neuenhof; Ekkehard Schade, Wettingen, all of Switzerland

[73] Assignee: BBC Brown, Boveri & Company, Limited, Baden, Switzerland

[21] Appl. No.: 260,203

[22] Filed: May 4, 1981

[30] Foreign Application Priority Data

May 7, 1980 [CH] Switzerland ..... 3545/80

[51] Int. Cl.[3] ..... H01H 33/70; H01H 33/82

[52] U.S. Cl. ..... 200/147 R; 200/148 A

[58] Field of Search ..... 200/147 R, 148 A, 148 R, 200/150 G

[56] References Cited

U.S. PATENT DOCUMENTS

| | | | |
|---|---|---|---|
| 4,221,942 | 9/1980 | Hertz et al. | 200/147 R X |
| 4,286,128 | 8/1981 | Ruffieux et al. | 200/147 R X |
| 4,303,814 | 12/1981 | Scheibe | 200/147 R |
| 4,329,551 | 5/1982 | Bernard et al. | 200/147 R |

*Primary Examiner*—J. R. Scott

*Attorney, Agent, or Firm*—Burns, Doane, Swecker & Mathis

[57] ABSTRACT

A high voltage power switch for alternating current has a stationary, hollow contact, an axially displaceable contact, a nozzle through which compressed gas is directed into an expansion chamber, and a cylindrical coil. The coil is connected at one of its ends with a first part of the hollow contact, and at its other end with a second part of the stationary contact. In a switch of this type, the disconnect capacity is improved by an increased exchange of gas between the arc and the surrounding compressed gas, while the dimensions of the coil connected with the hollow contact and the magnitude of the flow of compressed gas are relatively small. These features are obtained by configuring the first part of the stationary contact as a nozzle, and providing a compression device, actuated by the contacts, to produce a flow of compressed gas of a magnitude so that the arc is commutated from the first part to the second part of the contact within a period of time that is short compared with the duration of the half-wave of the current, prior to the time the current changes polarity.

4 Claims, 1 Drawing Figure

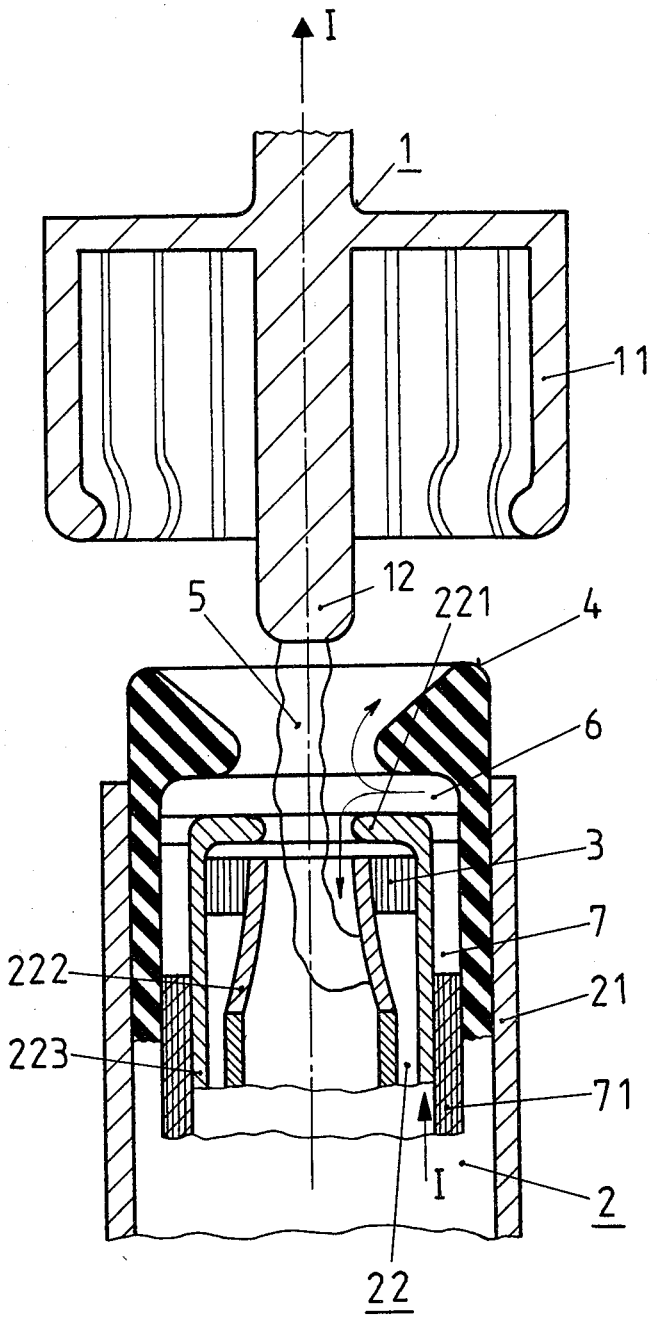
I
1
11
12
5
221
4
6
3
7
222
21
223
71
I
2
22

HIGH VOLTAGE POWER SWITCH

BACKGROUND AND SUMMARY OF THE INVENTION

The present invention relates to a high voltage power switch having an axially displaceable contact and utilizing compressed gas and an electromagnetic field to distinguish arcs formed upon opening of the contacts.

A switch of this type is generally disclosed in European Patent Application No. 0,004,213. In the contact opening operation of this switch, the pressure of the gas present in a compression chamber is increased as the result of heating by the electric arc formed between the contacts. The arc is rotated by a radial magnetic field, and blown by the heated pressurized gas to extinguish it. In order to obtain a high contact disconnect capacity in a switch of this type, it is necessary that the coil connected to the hollow stationary contact be large enough so that it is capable of absorbing the entire quenching current. However, an adequately dimensioned coil will substantially increase the cost of the switch. Furthermore, the quenching capacity of the switch is not optimal even when using large coils, because the heat generated by the electric arc cannot be removed rapidly enough from inside the switch.

It is therefore the general object of the present invention to provide a novel switch wherein the contact disconnect capacity is increased by means of an improved exchange of gas between the arc and the surrounding pressurized gas, and wherein the coil connected with the hollow commutating contact has small dimensions.

This and other objects and advantages are obtained according to the present invention by configuring the stationary commutating contact as a nozzle, and using the compressed gas to commutate the arc from a first part to a second part of the stationary commutating contact during a half-wave of the extinguishing current. The switch according to the invention is advantageous in that only a slight quenching current flows through the coil connected with the stationary commutating contact only shortly before the current flow stops as it changes from one polarity to the other. The oil therefore has relatively small dimensions. In addition, the commutating contact is designed so that a magnetic field extending in the axial direction acts on a large part of the arc. The forces generated by the axial magnetic field pump energy into the random, tuburlent motion of gas and produce a particularly strong breaking of the arc in the expansion chamber, thus resulting in a high extinguishing capacity of the switch.

In one particular embodiment, the nozzle portion of the commutating contact forms a shading ring. Thus, the magnetic field of the coil is limited, by the shading ring, to the expansion chamber of the switch. By means of material recesses provided in the commutating contact, the axial magnetic field may be confined in a particularly appropriate manner inside the contact.

Furthermore, by providing a piston in the annular space between the commutating contact and a gas flow directing nozzle, the commutation of the arc from the first to the second part of the commutating contact is obtained safely by the use of simple means, even in the case of very low currents.

Further advantages and features of the invention will be appreciated upon a perusal of the followed detailed description of a preferred embodiment of the invention.

BRIEF DESCRIPTION OF THE DRAWING

The single FIGURE is a cross sectional view through the contacts of a high voltage power switch constructed according to the invention.

DETAILED DESCRIPTION

In the FIGURE, a moving contact 1 and a stationary contact 2 are displayed during the opening of the high voltage power switch. The moving contact 1 has a continuous current, or main, contact portion 11 and commutating contact portion 12. The stationary contact 2 also has a main contact portion 21 and commutating contact portion 22. The stationary commutating contact 22 consists of two parts 221 and 222. The first part 221 is annular in shape, has a current connection terminal 223 and has the configuration of a nozzle. The second part 222 is in the shape of a hollow pin and may be provided with material recesses, i.e., is tapered, in the axial direction.

The end of the second part 222 of the stationary commutating contact 22 that faces the moving contact 1 is surrounded by a coil 3. The end of the coil at its interior circumferential surface is connected to the second part 222, and its outer end is connected to the first part 221, of the commutating contact 22. The first part 221 forms the narrowing part of the nozzle of the commutating contact 22 and overlaps both the frontal surface of the coil 3 that faces the moving contact 1 and the second part 222 of the commutating contact.

A nozzle 4 made of an insulating material is axially offset with respect to the stationary commutating contact 22 and defines, together with the contact 22, a channel 6, whereby, as indicated by the arrows, compressed gas is blown into the expansion chamber of the switch, from a compression device 7 with a piston 71 frictionally coupled to the movable contact.

In the closed position of the switch, the movable commutating contact 12 extends into the nozzle 4 of insulating material and overlaps, together with the hollow commutating contact 22 of the stationary contact 2, the contact pin. Simultaneously, the two main contacts 11 and 12 are electrically connected with each other. Upon opening of the switch, the two main contacts are initially separated from each other and the current I is commutated from the main current path to the commutating current path. The current I flows from the connection 223, through the first part 221 of the stationary commutating contact to the movable commutating contact 12. As soon as the connection between the commutating contacts 12 and 22 is broken, an electric arc 5 forms between these contacts. This arc is blown slightly by a flow of quenching gas from the channel 6. The force of the flow of quenching gas is such that the arc 5 is commutated from the first part 221 to the second part 222 of the arcing contact 22 over a period of time that is short with respect to the half-wave of the existing current, for example several milliseconds, prior to the zero current point where the current switches from one polarity to the other.

The current I now flows from the connection 223 through the coil 3, the second part 222 of the commutating contact 22 and the arc 5 to the movable commutating contact 12. In addition to the blowing effect of the quenching gas, the arc 5 is now affected by the force of the magnetic field of the coil 3. The magnetic flux lines of the coil 3 extend in the first part 221 of the commutating contact 22 parallel to the axis of the arc and the direction of flow of the compressed gas. The arc 5 is therefore rotated to a negligible extent in this area of the parallel magnetic field and the blowing gas. On the other hand, energy is being pumped from the magnetic field into the random, turbulent gaseous motion of the arc column 5. This leads, in contrast to conventional, transversely blown arcs which are rotating as a whole in a transverse field, to the breaking of the arc in this area and to a particularly effective mixing of the arc 5 with the surrounding cold gas.

The switch according to the invention is particularly significant in that both the coil 3 and the compression apparatus 7 are relatively small. It is not necessary to dimension the coil 3 so that it is rated for full current, and the compression device 7 is required to produce merely a flow of compressed gas strong enough to commutate the arc 5 from the first part 221 of the commutating contact 22 to the second part 222.

A particularly high quenching capacity of the switch according to the invention is obtained by limiting the axial magnetic field inside the hollow commutating contact 22. This may be effected by designing the first part 221 of the commutating contact 22 as a shading ring. In view of the limited axial magnetic field, it is advantageous to provide a further shading ring for the side of the coil 3 facing away from the movable contact 1. The two shading rings provide the additional advantage of maintaining the axial magnetic field, at least partially, at the time of zero current flow.

The present invention may be embodied in other specific forms without departing from the spirit or essential characteristics thereof. The presently disclosed embodiment is therefore considered in all respects as illustrative and not restrictive. The scope of the invention is indicated by the appended claims rather than the foregoing description, and all change which come within the meaning and range of equivalency of the claims are therefore intended to be embraced therein.

What is claimed is:

1. A high voltage power switch for interrupting alternating current flow, comprising:

an axially displaceable commutating contact;

a stationary hollow commutating contact having a first part that is configured as a nozzle and a second part disposed within said first part;

a nozzle that defines a gas flow path in conjunction with said first part to direct a flow of compressed gas into an expansion chamber of the switch;

a cylindrical electromagnetic coil disposed between said first and second parts of said stationary contact and electrically connected between said first and second parts to generate a magnetic field that is parallel to the axis of an arc formed between said contacts; and a compression device for producing a flow of compressed gas along said flow path defined by said nozzle, upon actuation of said contacts, having a magnitude sufficient to commutate an electrical arc between said contacts from said first to said second part of said stationary contact within a period of time that is shorter than the length of the half-wave of the current being interrupted and prior to the time that the current changes polarity to thereby energize said coil and magnetically extinguish the arc.

2. The high voltage power switch of claim 1 wherein said nozzle-shaped first part overlies one surface of said coil to function as a magnetic shading ring.

3. The high voltage power switch of claim 1 or 2 wherein said second part of said stationary contact is axially tapered.

4. The high voltage power switch of claim 1 wherein said nozzle is axially displaced from said first part of said stationary contact and defines an annular space between itself and said first part, and wherein said compression device comprises a piston adapted for movement within said annular space.

* * * * *